United States Patent [19]

Tillmann

[11] Patent Number: 4,483,043

[45] Date of Patent: Nov. 20, 1984

[54] AUTOMATIC DOOR CLOSER

[75] Inventor: Horst Tillmann, Ennepetal, Fed. Rep. of Germany

[73] Assignee: Dorma-Baubechlag GmbH & Co. KG, Ennepetal-Voerde, Fed. Rep. of Germany

[21] Appl. No.: 468,305

[22] Filed: Feb. 22, 1983

Related U.S. Application Data

[63] Continuation-in-part of Ser. No. 225,404, Jan. 15, 1981, Pat. No. 4,376,323.

[30] Foreign Application Priority Data

Jan. 16, 1980 [DE] Fed. Rep. of Germany ..... 3001406

[51] Int. Cl.[3] ..... E05F 3/10; E05F 3/22

[52] U.S. Cl. ..... 16/56; 16/53; 16/58; 16/48.5; 16/72; 16/DIG. 9

[58] Field of Search ..... 16/48.5, 51, 52, 53, 16/56, 58, 66, 71, 82, 84, DIG. 9, DIG. 10, DIG. 17, DIG. 21

[56] References Cited

U.S. PATENT DOCUMENTS

| | | | |
|---|---|---|---|
| 3,852,846 | 12/1974 | Slaybaugh | 16/51 X |
| 3,875,612 | 4/1975 | Paitras | 16/51 X |
| 4,050,114 | 9/1977 | Zunkel | 16/51 X |
| 4,080,687 | 3/1978 | Jentsch | 16/56 X |
| 4,115,897 | 9/1978 | Zunkel | 16/51 X |
| 4,234,996 | 11/1980 | Jentsch | 16/58 X |
| 4,263,694 | 4/1981 | Jentsch | 16/52 X |
| 4,267,619 | 5/1981 | Suska | 16/52 X |
| 4,376,323 | 3/1983 | Lillmann | 16/51 |

*Primary Examiner*—Donald R. Schran

*Assistant Examiner*—James Wolfe

*Attorney, Agent, or Firm*—Michael J. Striker

[57] ABSTRACT

An automatic door closer has an elongated fluid-filled housing having a closed end and an opposite open end, a plug closing the open end of the housing, a first piston reciprocatably arranged in the housing and dividing the latter into a first pressure space adjacent the closed end and a second pressure space adjacent the plug, a closer shaft adapted to be connected to a door, extending transverse to the elongation of the housing and turnably mounted in the housing in the region of the closed end, elements connecting said closer shaft with said first piston for moving the latter during turning of the closer shaft in door-opening direction in a first direction reducing the volume of the first pressure space while increasing the volume of the second pressure space, the piston-moving elements comprising a piston rod slidingly guided in the first piston and having a free end facing the plug, a spring cooperating with the first piston for biasing the latter in a second direction opposite to the first direction, a first throttled passage communicating at one end with the first pressure space and at the other end with a cylinder space formed in the first piston, a second throttled passage communicating at opposite ends respectively with the first and said second pressure space, a valve in the second throttled passage mavable between a closed position preventing flow of fluid through the second passage and an open position permitting flow of fluid through the second passage; and a second piston which is stationary and formed as a projection of the plug movably received in the cylinder space of the first piston.

10 Claims, 3 Drawing Figures

AUTOMATIC DOOR CLOSER

CROSS-REFERENCE TO RELATED APPLICATION

This application is a continuation-in-part of application Ser. No. 225,404, filed Jan. 15, 1981, now U.S. Pat. No. 4,376,323.

BACKGROUND OF THE INVENTION

The present invention relates to an automatic door closer.

More particularly, it relates to a door closer with a closer shaft adapted to be connected to a door, and in which the closer shaft is turnably mounted in the region of the one end of an elongated housing in opposite directions from a position in which the door is closed. A cam disk is connected within the fluid-filled housing to the closer shaft for turning therewith, and this cam disk cooperates, by means of rollers fixed to a longitudinally movable slide, to move the latter in the longitudinal direction of the housing during turning of the door in either direction from the closed position. The slide is connected to a piston of a hydraulic damping arrangement and a spring arrangement forming an energy storage. The piston divides the interior of the housing into two pressure spaces which are connected to each other by channels for the throttled flow of the pressure medium from one pressure space, the volume of which is reduced during closing of the door, into the other pressure space.

With a door closer of the aforementioned type, which may be constructed as a closer mounted in an appropriate cavity in the floor, an automatic closing of the door will be obtained after each opening of the same, since the pressure medium can flow through the aforementioned channels from the pressure space, the volume of which is reduced during closing of the door, back into the other pressure space, in which the spring arrangement providing the closing force is arranged. This known door closer is provided forwardly and rearwardly of the piston with two channels, offset in the longitudinal direction of the housing, in which throttle devices are arranged through which the backflow speed of the pressure fluid from one pressure space into the other may be regulated. Thereby it is possible to dampen the first phase of the closer movement of the door to a lesser degree than the second phase of the door closing movement, so that the door will be moved without impact by the return spring to the closed position. During the opening movement of the door, the action of the throttle channels will be obviated by arranging a one-way valve in the piston which provides communication between the two pressure spaces during the closing movement of the door. However, the force of the closing spring must be overcome during the opening movement of the door. Especially at so-called fire doors which during existence of a fire have to be moved to a closed position, it is desirable that the door, during normal conditions, be easily movable, as a door without door closer, so that the door may be moved also by children without danger.

These objects are attained in a door closer disclosed in application Ser. No. 225,404, filed on Jan. 15, 1982.

The automatic door closer according to this application mainly comprises an elongated fluid-filled housing having a closed end and an opposite open end, a plug closing the open end of the housing, a first piston reciprocatably arranged in the housing and dividing the latter into a first pressure space adjacent the closed end of the housing and a second pressure space adjacent the plug, a closer shaft adapted to be connected to a door, extending transverse to the elongation of the housing and being turnably mounted in the housing in the region of the closed end, means connecting the closer shaft with the first piston for moving the latter, during the turning of the closer shaft in door-opening direction, in a first direction reducing the volume of the first pressure space but increasing the volume of the second pressure space, the piston-moving means comprising a piston rod slidably guided in the first piston and having a free end facing the plug, the plug being formed with a blind bore coaxial with the piston rod and having an open end facing the latter, spring means cooperating with the first piston for biasing the latter in a second direction opposite to the first direction, a second piston fixed to the free end of the piston rod and extending into the blind bore, first throttled passage means communicating at one end with the first pressure space and at the other end with a cylinder space formed between the closed end of the blind bore and the facing end of the second piston, second throttled passage means communicating at opposite ends respectively with the first and the second pressure space, and operator-controlled valve means in the second passage means movable between a closed position preventing flow of liquid through said second throttled passage means and an open position permitting flow through said second throttled passage means. The operator-controlled valve means is preferably an electromagnetically operated valve, and when the latter is moved to the closed position a pressure medium cushion will build up during the first opening of the door which will hold the first piston in the position it reaches at the end of the opening movement of the door, which will hold the first piston against the force of the spring means in the position thus arrived at. On the one hand, the door can then rest in any open position when the door is released, since the force of the closer spring is not acting. On the other hand, the door may be closed without exerting a relatively large force, since the second piston can be moved relative to the first one, and the pressure fluid has only to flow through the first throttled passage means, between the first pressure space and the cylinder space. Thus, in this construction the door closer function can, if desired, comp eliminated but retaining this function in case of danger, for instance during a fire, so that normally an easy opening and closing of the door by hand is possible.

In the above described door closer the second piston is fixed to the free end of the piston rod and moves together with the latter. This has the disadvantage that the seals of the first piston and the second piston are subjected to dynamic loads, and the construction is relatively difficult to manufacture and has a considerable length.

SUMMARY OF THE INVENTION

Accordingly, it is an object of the present invention to provide a door closer which avoids the disadvantages of the prior art.

More particularly, it is an object of the present invention to provide a door closer in which the door closer functions can, if desired, completely be eliminated but retaining this function in case of danger so that normally an easy opening and closing of the door by hand is possible, and which at the same time has a less complicated construction, is structurally short, and acts so that seals of its pistons are subjected to only static loads.

In keeping with these objects and with others which will become apparent hereinafter, one feature of the present invention resides in an automatic door closer which has an elongated fluid-filled housing having a closed end and an opposite open end, a plug closing the open end of the housing, a first piston reciprocatably arranged in the housing and dividing the latter into a first pressure space adjacent the closed end and a second pressure adjacent the plug, a closer shaft adapted to be connected to a door, extending transverse to the elongation of the housing and turnably mounted in the housing in the region of the closed end, elements connecting said closer shaft with said first piston for moving the latter during turning of the closer shaft in door-opening direction in a first direction reducing the volume of the first pressure space while increasing the volume of the second pressure space, the piston-moving elements comprising a piston rod slidingly guided in the first piston and having a free end facing the plug, a spring cooperating with the first piston for biasing the latter in a second direction opposite to the first direction, a first throttled passage communicating at one end with the first pressure space and at the other end with a cylinder space formed in the first piston, a second throttled passage communicating at opposite ends respectively with the first and said second pressure space, a valve in the second throttled passage means movable between a closed position preventing flow of fluid through the second passage means and an open position permitting flow of fluid through the second passage means, and a second piston, wherein the second piston is stationary and formed as a projection of the plug movably received in the cylinder space of the first piston.

When the door closer is designed in accordance with the present invention, its function, if desired, can completely be eliminated, but this function can be retained in case of danger, for instance during a fire, so that normally an easy opening and closing of the door by hand is possible. At the same time, if compared with the door closer of application Ser. No. 225,404, the door closer with the stationary second piston formed as a projection of the plug extending into the cylinder chamber of the first piston in accordance with the present invention, is easier to manufacture and has a shorter structural length. The most important advantage is that the seals of the first piston and the second piston are subjected to substantially static load, since in normal condition the first piston is stationary and only the piston rod with its flange pin reciprocates in the first piston. When the first piston is immovable during pressure increase, both its seal and the seal of the second piston remain at the same location, so that dynamic load of the seals takes place only when the door closer will complete its closing function urged by the spring. The latter case takes place relatively seldom, as compared with frequent opening and closing movements of the door closer with the immovable first piston. A further advantage of the inventive door closer is that one seal can be dispensed with.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
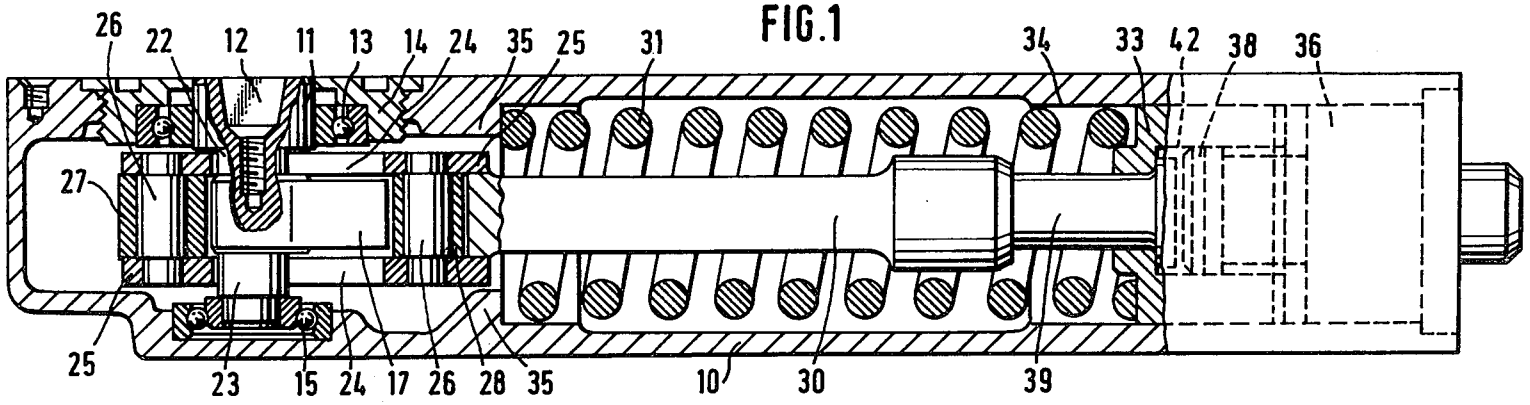
FIG. 1 is a partially sectioned side view of the door closer according to the present invention, which is illustrated in FIG. 1 in condition corresponding to the closed position of the door.
Figure 2:
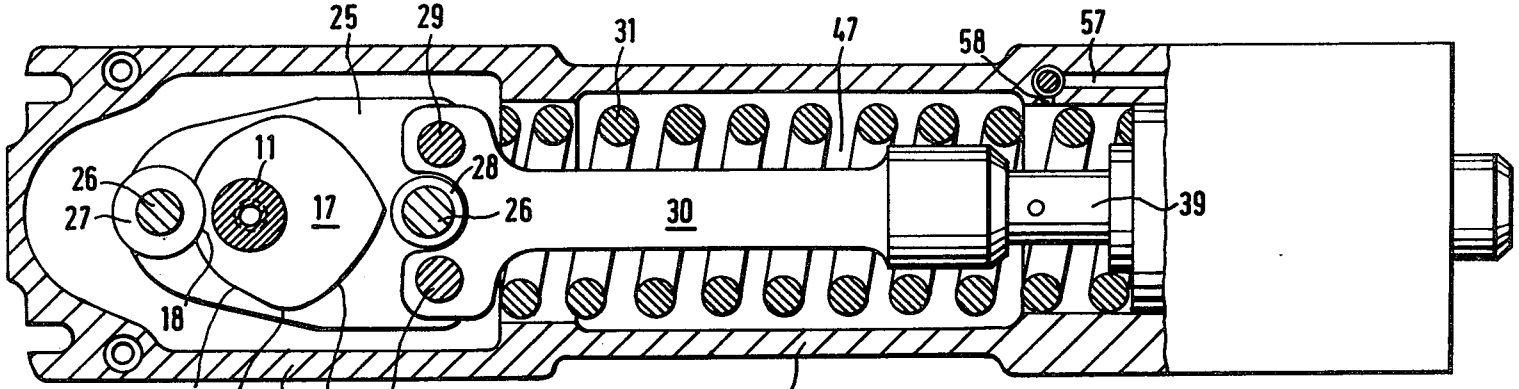
FIG. 2 is a partially sectioned top view of the door closer shown in FIG. 1.
Figure 3:
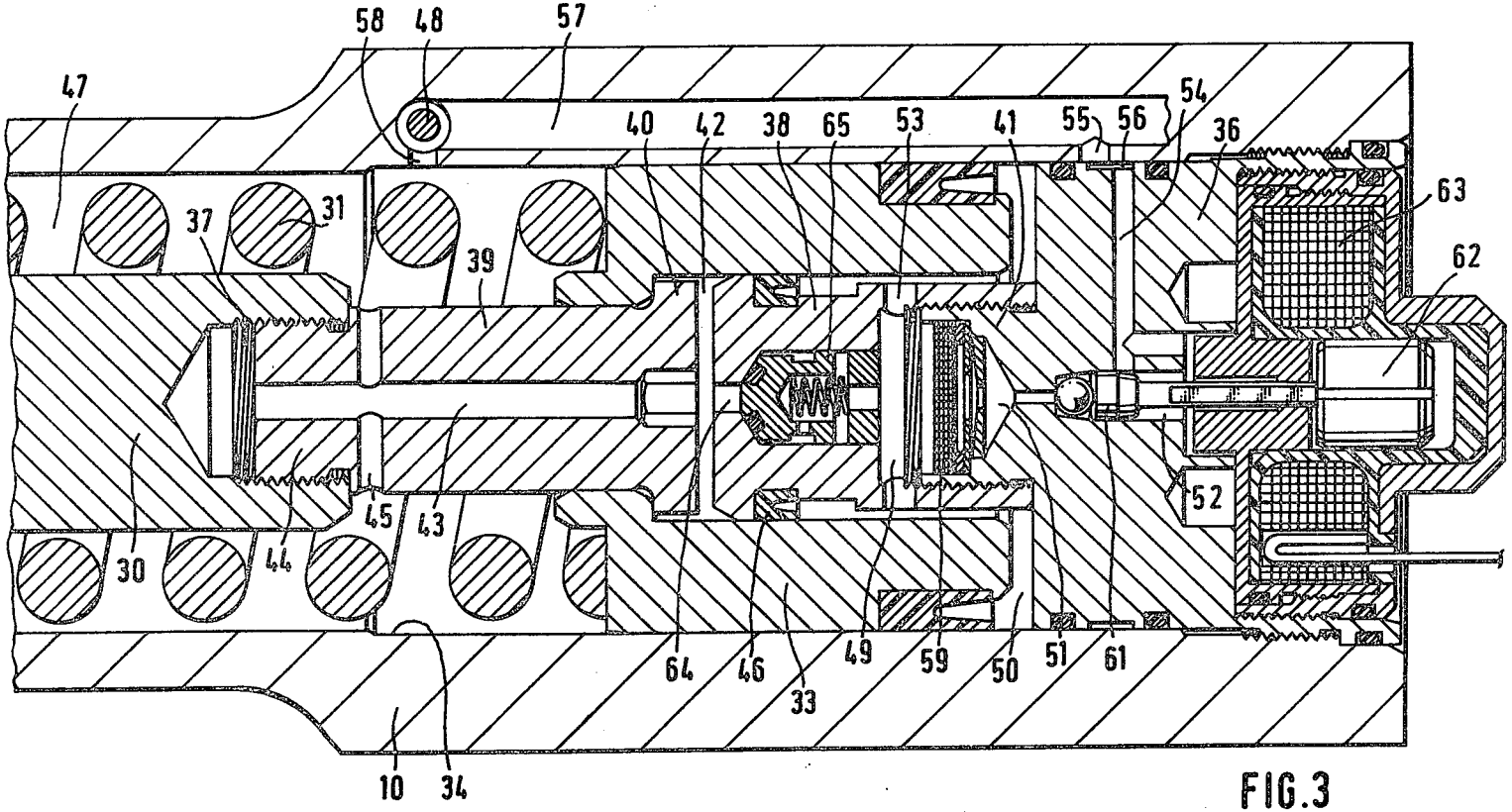
FIG. 3 illustrates the rear portion of the door closer on an enlarged scale.

The door closer according to the present invention comprises a housing 10 to be filled with pressure fluid, for instance oil. The housing 10 has a closed end and an opposite open end closed by a plug 36. A door closer shaft 11 is turnably mounted in the region of the closed end of the housing 10 extending normal to the elongation of the housing. The closer shaft 11 is provided at its upper end with a non-round recess 12 for receiving a non-illustrated pivot pin to be coupled with the door. An upper bearing 13 located in a bearing ring 14 threadedly connected with the housing, and a lower bearing 15 in the housing, turnably mount the closer shaft 11. The closer shaft is sealed by a sealing ring in the bearing ring 14. A cam disk 17 is fixed to the closer shaft 11 within the housing head space 16. The cam disk 17 has two regions mirror-symmetrically arranged with respect to a central plane thereof. The cam disk 17 is provided at its periphery with an indentation 18 determining the closed position of the door and further with two gradually rising zones 19 and 20 and a further rising zone 21. A pair of plates 25 provided with elongated guide slots 24, through which the closer shaft extends, are arranged with slight clearance with respect to the cam disk 17 in the regions 22 and 23 above and below the cam disk. The plates 25 are connected to each other by trunnions 26, the reduced-diameter portion of which are located in corresponding bores of the plates 25, whereas the large-diameter portions of the trunnions 26 respectively turnably mount rollers 27 and 28. The rollers 27 and 28 cooperate with the cam disk 17 in such a manner that the latter, in any turned position thereof, is located with slight clearance between the same. The slide formed by the plates 25 is connected with a piston rod 30, for instance by rivets 29. The piston rod 30 passes through a coiled compression spring 31 serving as an energy accumulator, and the spring 31 abuts in the region of the free end of the piston rod 30 against a first piston 33 which is sealingly reciprocatable in a cylinder bore 34 of the housing 10. The end of the spring 31 facing the closer shaft 11 engages an abutment 35 formed in the housing. The cylinder bore 34 is closed by the aforementioned closer plug 36.

The piston rod 30 has at its end a circular cross section and a threaded bore 37. A flange pin 39 is screwed in the threaded bore 37. The flange pin 39 has a collar 40 which engages in the piston 33 in such a manner that the annular face of the collar 40, which is directed toward the piston 33, engages the piston and can move the latter against the force of the coiled compression spring 31 which serves as a closing spring. The plug 36 has an annular projection 41. A second stationary piston 38 is screwed on the annular projection 41 and extends into a cylinder chamber 42 of the first piston 33, sealed by a sealing ring. The cylinder chamber 42 communicates with a first pressure space 47 over first passage means formed by a longitudinal bore 43 in the flange pin 39 and a transverse bore 45 provided in the flange pin 44 and opening into the first pressure chamber 47.

A second pressure chamber is formed by the piston 33. The cylinder chamber 42 is separated from the second pressure chamber 50 by a sealing ring 46. A radial bore 53 extends from the second pressure chamber 50 in the second piston 38 and opens into a piston chamber 49. A stepped bore 51 is provided in the annular projection 41 and leads from the piston chamber 49 to a valve chamber 52 in the plug 36. A radial bore 54 is arranged in the plug 32 and extends from the valve chamber 52. An annular groove 56 on the periphery of the plug 36 opens into the radial bore 54. A transverse bore 55 is provided in the housing 10. It extends from the cylinder bore 34 in correspondence with the annular groove 56 and opens into a longitudinal bore 57 in the wall of the housing. A further transverse bore 58 is connected with the longitudinal bore 57 and opens into the first pressure space 47 in such a manner that the transverse bore 58 cannot be closed by the piston 33 at any time.

A throttle 48 is located between the longitudinal bore 57 and the transverse bore 58. It can throttle flow through second passage means formed by the stepped bore 51, the valve chamber 52, the radial bore 54, the annular groove 56, the transverse bores 55 and 58 and the longitudinal bore 57. An oil sieve 59 which retains dirt and residue is arranged in the stepped bore 51. The second passage means which can be closed by a valve member 61 which moves longitudinally in the valve chamber 52. The valve member 51 abuts in its closed position against an armature 62 of an electromagnet 63 arranged in the plug 36 rearwardly of the valve member 61.

Additional passage means 64 through the second piston 38 connect the cylinder chamber 52 with the second pressure space 50, and a spring-biased one-valve valve 65 is arranged in this additional passage means permitting flow of pressure fluid from the first pressure space 47 to the second pressure space 50 when the first piston 33 is moved in door-opening direction by the collar 40.

The above described door closer may be operated as follows. If the electromagnet 63 is energized, the valve member 61 in the valve member 52 will be held in the closed position, so that the pressure fluid cannot pass between the first pressure space 47 and the second pressure space 50 over the second throttle passage means including the valve chamber 52. If the door closer is now moved during the first opening of the door from the position shown in the drawings, the piston rod 30 is moved toward the left, as viewed in the various Figures, so as to move the flange pin 39 of the piston 33 by means of the collar 40 against the force of the spring 31. Thereby pressure fluid will be displaced from the first pressure space 47 and flow over the passage 45 and 43 first into the cylinder chamber 42 and from there, due to the thus forming overpressure, over the passage 64 and the one-way valve 65, as well as the radial bore 53 and the annular gap between the inner bore of the piston 33 and the thinner shaft of the piston 38 into the second pressure space 50.

When now thereafter, at the end of the door-opening movement, the door is released, there will be created, due to the force of the coiled compression spring 31, such a pressure in the second pressure space 50 that the piston 33 will remain in the position at which during the door-opening movement, since the pressure fluid could flow only back into the first pressure space 47 over the second throttle passage means containing the valve chamber 52 which, however, are closed by the valve member 61. When the piston 33 is thus held as described above, the door may be easily closed or opened, since the flange pin 39, together with the piston rod 30, may easily reciprocate in the cylinder chamber 52, since the cylinder chamber 52 and the first pressure space 47 are connected with one another over the passage 43, 45. Only when the support of the valve member 61 by the electromagnet is removed, can the compression spring 31 press the piston 33 and therewith the piston rod 30 over the collar 40 back to the closing position shown in the drawing, so that the pressure fluid can flow over the passage 51, 54, 56, 55, 67, 58 opened by the valve member 61 from the second pressure space 50 into the first pressure space 47, throttled by the throttle 48. The deenergizing of the electromagnet 63, to permit the valve member 61 to move from the closed to the open position, may be carried out automatically, for instance by a smoke detector or the like, or by a manually activated switch or the like.

It will be understood that each of the elements described above, or two or more together, may also find a useful application in other types of constructions differing from the types described above.

While the invention has been illustrated and described as embodied in an automatic door closer in which the automatic closer function of the closer may be eliminated so that the door may be easily moved by hand between an open and a closed position, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An automatic door closer comprising an elongated fluid-filled housing having a closed end and an opposite open end; a plug closing said open end of said housing; a first piston reciprocatably arranged in said housing and dividing the latter into a first pressure space adjacent said closed end and a second pressure space adjacent said plug, said first piston having a cylinder space therein; a closer shaft adapted to be connected to a door, extending transverse to the elongation of said housing and being turnably mounted in said housing in the region of said closed end; means connecting said closer shaft with said first piston for moving the latter, during turning of the closer shaft in door-opening direction, in a first direction reducing the volume of said first pressure space while increasing the volume of said second pressure space, said piston-moving means comprising a piston rod slidingly guided in said first piston and having a free end facing said plug; spring means cooperating with said first piston for biasing the latter in a second direction opposite to said first direction; a second stationary piston formed as a projection of said plug and movably received in said cylinder space of said first piston; first throttled passage means communicating at one end with said first pressure space and at the other end with said cylinder space; second throttled passage means communicating at opposite ends respectively with said first and said second pressure space; and valve means in said second throttled passage means movable between a closed position preventing flow of fluid through said second passage means and an open position permitting flow of fluid through said second passage means.

2. An automatic door closer as defined in claim 1, wherein said connecting means further include a cam disk connected to said closer shaft for turning therewith and a slide carrying a pair of rollers cooperating with said cam disk for moving said slide in longitudinal direction during turning of said cam disk, said piston rod being fixed to said slide for movement therewith.

3. An automatic door closer as defined in claim 1, wherein said spring means comprises a coiled compression spring arranged in said first pressure space about said piston rod and abutting with opposite ends against said first piston and an abutment in said housing.

4. An automatic door closer as defined in claim 1, wherein said connecting means further include a collar connected with said piston rod and adapted to engage said first piston when the latter is moved by said connecting means in said first direction.

5. An automatic door closer as defined in claim 4, wherein said connecting means further include a pin connected with said piston rod, said collar being arranged on an end of said pin.

6. An automatic door closer as defined in claim 1; and further comprising an annular projection, said second piston being screwed with said plug through said annular projection.

7. An automatic door closer as defined in claim 6, wherein said annular projection is of one piece with said plug and has a thread, said second piston having a thread to be screwed with the thread of said annular projection.

8. An automatic door closer as defined in claim 1; and further comprising additional passage means connecting said cylinder space with said second pressure space and a one-way valve in said additional passage means.

9. An automatic door closer as defined in claim 8, wherein said additional passage means and said one-way valve are arranged in said second piston.

10. An automatic door closer as defined in claim 1, wherein said valve means is an electromagnetically operated valve.

* * * * *